US005913290A

United States Patent [19]

Kvamsdal et al.

[11] Patent Number: 5,913,290

[45] Date of Patent: Jun. 22, 1999

[54] POWER PLANT

[75] Inventors: Rolf Kvamsdal, Oslo; Magnar Førde, Hundhamarn, both of Norway

[73] Assignee: Kvaerner ASA, Lysaker, Norway

[21] Appl. No.: 08/930,714

[22] PCT Filed: Apr. 30, 1996

[86] PCT No.: PCT/NO96/00102

§ 371 Date: Sep. 29, 1997

§ 102(e) Date: Sep. 29, 1997

[87] PCT Pub. No.: WO96/35046

PCT Pub. Date: Nov. 7, 1996

[30] Foreign Application Priority Data

May 2, 1995 [NO] Norway ..... 95 1696

[51] Int. Cl.[6] ..... F02B 71/00

[52] U.S. Cl. ..... 123/46 R; 60/595

[58] Field of Search ..... 60/595; 123/46 R, 123/46 B

[56] References Cited

U.S. PATENT DOCUMENTS

| | | | |
|---|---|---|---|
| 2,666,569 | 1/1954 | Bent | 60/595 |
| 2,815,641 | 12/1957 | Ramsey et al. | 123/46 R |
| 4,372,256 | 2/1983 | Firey | 123/23 |
| 4,481,772 | 11/1984 | Benaroya | 60/595 |
| 4,815,294 | 3/1989 | David | 60/595 |
| 4,873,822 | 10/1989 | Benaroya | 60/595 |

FOREIGN PATENT DOCUMENTS

| | | | |
|---|---|---|---|
| 0429125 A3 | 5/1991 | European Pat. Off. . | |
| 4024591 | 2/1992 | Germany . | |
| 423777 | 2/1935 | United Kingdom | 123/46 R |

OTHER PUBLICATIONS

Von Prof. Dipl.–Ing "Verbrennungskraftmaschinen", 1962, pp. 37–39.

*Primary Examiner*—Noah P. Kamen
*Attorney, Agent, or Firm*—Merchant, Gould, Smith, Edell, Welter & Schmidt

[57] ABSTRACT

A power unit with a diesel free piston device which is fed with air from a compressor device (96), and whose exhaust gas runs a turbine (150). The device has a cylinder (12) with two pistons (24, 26) which are movable in anti-phase and which between them define a combustion chamber (54). The cylinder end sections (36, 38) comprise buffer end chambers (56, 58). An electronic device (160) controls the pressure of the air in the end chambers (56, 58, 256, 258). A central piston section (48, 50) of each piston together with a related cylinder section (40, 42) forms a piston pump chamber (68, 70) which supplies the device's inlet manifold (80) and a mixing chamber (148) with compressed air, exhaust gases and the compressed air being mixed in the mixing chamber before being passed to the turbine (150). The electronic device (160) also controls the pressure of the air in the compression chambers (68, 70) by means of the compressor device, valves, pressure sensors, etc.

2 Claims, 3 Drawing Sheets

POWER PLANT

FIELD OF THE INVENTION

The invention relates to a power unit with a diesel free piston device, a compressor device, a turbine and an electronic device, wherein the free piston device has a cylinder and two pistons movable in anti-phase. The first end sections of the two pistons are adjacent to each other and define a combustion chamber, and the second end sections of the pistons are remote from each other defining end chambers together with the cylinder, the compressor device supplies air to the free piston device via an inlet manifold, the free piston device supplies exhaust gas to the turbine, and the electronic device is arranged to control the pressure of the air in the end chambers in order to control the movement of the pistons.

BACKGROUND OF THE INVENTION

In the applicant's Norwegian application no. 950916 there is disclosed a device of the above-mentioned type, wherein the compressor device is composed of a turbocompressor and the pressure of the air that is supplied to the free piston device's combustion chamber during an air purging sequence substantially corresponds to the compressor device's supply pressure. The energy for operating the compressor can be provided, e.g., by an electric motor that is supplied with electric power from a generator, which in turn is driven by the turbine.

SUMMARY OF THE INVENTION

The object of the invention is to provide a power unit of the type mentioned in the introduction with very high thermal efficiency, but where the temperature of the gas which is supplied to the turbine is relatively low.

The characteristics of the invention are illustrated by the features in the claims presented.

BRIEF DESCRIPTION OF THE DRAWING

The invention will now be described in more detail with reference to the drawing which schematically illustrates embodiments of the unit according to the invention.

DETAILED DESCRIPTION OF THE INVENTION

Figure 1:
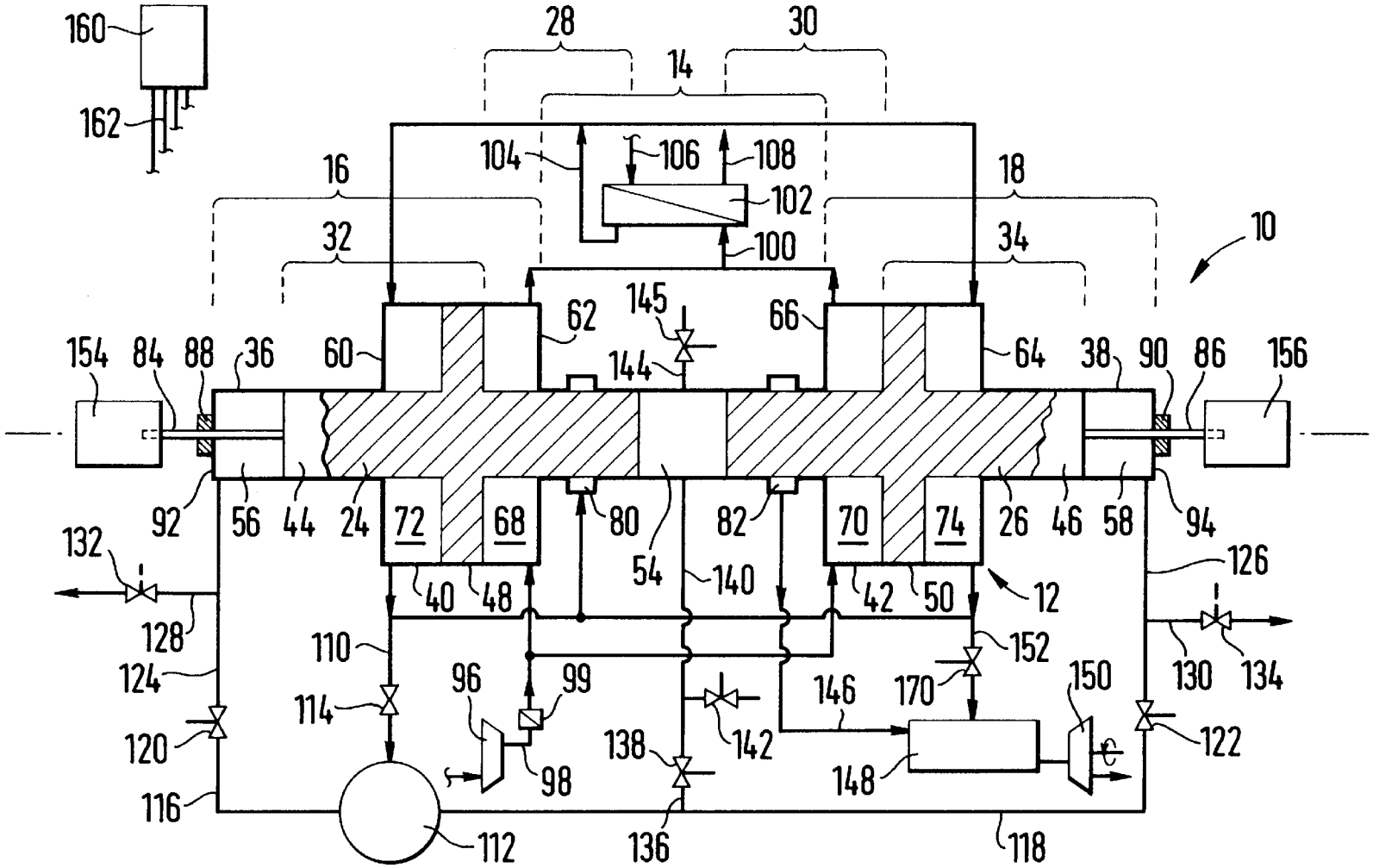
FIG. 1 illustrates a pipe arrangement for a first embodiment of a power unit according to the invention, and a longitudinal section through the power unit's free piston device.

In the following description, the terms right, left, upper and lower should be understood to indicate positions with reference to the figures as these are viewed by the reader, the terms upper and lower implying positions located close to and remote from the edge of the drawing closest to the reader.

FIG. 1 comprises a longitudinal section through a free piston device or gas generator 10 comprising a cylinder 12 with a first cylinder section 14 located at the cylinder's central section, and second cylinder sections 16,18 located at respective ends of the cylinder 12.

In the cylinder 12 there are slidably provided a left and a right piston 24 and 26 respectively with a first end section 28 and 30 whose diameter is adapted to the first cylinder section 14. Furthermore each piston 24,26 has a piston side section 32 and 34.

Each of the second cylinder side sections 16,18 comprises a second cylinder section 36 and 38 located at the respective ends of the cylinder, and a third cylinder section 40,42 located between the first cylinder section 14 and the second cylinder sections 36 and 38 and that have a larger diameter than these cylinder sections 14,36,38. Between each of the third cylinder sections 40,42 and the first cylinder section 14 and the second cylinder sections 36,38, therefore, there extends an external and an internal radial cylinder wall 60,62 and 64,66 respectively.

Similarly, each of the piston side sections 32,24 comprises a second piston end section 44 and 46 located at the piston ends that are located remotely relative to each other, and a third piston section 48 and 50 located between the first and the second piston end section 28,44 and 30,46 of the pistons 24 and 26.

Together with the first end sections 28,30 of the pistons 24,26, the first cylinder section 14 defines a working cylinder or a combustion chamber 54.

Each of the second cylinder sections 36,38 together with the respective second piston end sections 44,46 defines an end chamber or buffer chamber 56,58.

Together with the third cylinder sections 40,42 and the third piston sections 48,50, the internal, radial cylinder walls 62,66 define a first, left and right piston pump or compression chamber 68 and 70 respectively.

Together with the third cylinder sections 40,42 and the third piston sections 48,50, the external, radial cylinder walls 60,64 define a second, left and right compression chamber 72 and 74 respectively.

Near the left-hand end of the first cylinder section 14 there is provided an inlet manifold 80 arranged to communicate with the combustion chamber 54, and at the right-hand end of this cylinder section 14 there is provided an outlet manifold 82 similarly arranged to communicate with the combustion chamber 54.

Axially extending rods 84,86 are permanently connected to the axially external ends of the respective second piston sections 44,46, and extend sealingly through sealing devices 88 and 90 attached to end walls 92,94 of the second cylinder sections 36,38.

A compressor 96 which may be in the form of a turbocompressor, is arranged to feed the first compression chambers 68,70 with compressed air via a pipe 98.

A pipe 100 connects the first compression chambers 68,70 to the inlet of an intermediate cooler 102, and its outlet is connected via a pipe 104 to the respective second compression chambers 72,74. Coolant can be conveyed to and away from the intermediate cooler 102 via pipes 106,108.

A cooling device or an intermediate cooler 99 can be provided in the pipe 98.

A pipe 110 connects the second compression chambers 72,74 to the inlet manifold 80. An air bottle 112 is connected to the pipe 110 via a first valve 114 in the form of a non-return valve.

From the air bottle 112 there extend two pipes 116,118 to a second and a third valve 120 and 122 respectively, each of which is connected in turn via pipes 124 and 126 with end chamber 56 and 58 respectively.

From the pipes 124,126 there branch off pipes 128 and 130 in which there are provided a fourth and a fifth valve 132,134 respectively.

From the pipe 118 there extends a branch pipe 136 to a sixth valve 138 connected via a pipe 140 with the central section of the combustion chamber 54. A seventh valve 142 branches off from the pipe 140.

A pipe 144 for feeding fuel to the combustion chamber 54 can be closed and opened by means of an eighth valve 145.

The fourth, the fifth and the seventh valves 132,134 and 142 can effect the connection of the attached pipes to the surrounding atmosphere.

From the outlet manifold 82 there extends a pipe 146 to a mixing container 148 whose outlet is connected to the inlet of a turbine 150, arranged to drive, e.g., a propulsion propeller of a ship, a generator or the like (not shown).

The pipe 110 which extends from the second compression chambers 72,74 has an extension 152 which extends to the mixing chamber 148. In this pipe there can be provided an eighth, controlled valve 170.

Axially through the rods 84,86 there extend borings (not shown) which are connected to passages (not shown) in the pistons 24,26. Via the borings and the passages a coolant can be introduced into the pistons from the coolant containers 154,156 for cooling thereof during the operation of the free piston device.

An electronic device 160 which acts as a process computer or control unit for the power unit when a certain gate opening is set, is connected via electrical wires 162 with a number of sensors (not shown) in order to establish the pressure in some or all of the chambers 54,56,68,70,72,74, the air bottle 112 and the mixing container 148, the temperature in the chambers, the intermediate cooler and the mixing container, and any other sensors for monitoring the operation of the unit, such as sensors for establishing the position of the pistons. The latter can be arranged in connection with the rods 84,86.

Furthermore the process computer 160 is connected to each of the seven valves which can be of the magnetic valve type or be operated by means of extremely fast electric motors, thus enabling the valves not only to be moved between a closed and a fully open position, but also to be brought into positions between these positions.

The function of the power unit is as follows.

Starting of the free piston device which is initiated automatically by giving a start command to the process computer can be implemented in two ways, assuming that the pressure vessel 112 has been filled with compressed air.

In a first starting procedure the pistons are first brought into a position wherein they are located close to one another, the second, the third and the seventh valves 120,122 and 142 being opened while the fourth, the fifth and the sixth valves 132,134 and 138 remain closed. Air in the combustion chamber 54 can thereby be forced out into the open air via the seventh valve 142 while compressed air from the air bottle 112 forces the pistons 24,26 towards each other. The pressure in the end chambers 56,58 is then low and less than the pressure of the air in the air bottle 112. The second, third and seventh valves 120,122,142 are then closed and the sixth valve 138 (the starting valve) is opened, thus causing the pistons to be forced away from one another under compression of the air in the end chambers. When the pistons 24,26 uncover the outlet manifold 82, the pressure in the combustion chamber 54 drops rapidly and simultaneously the starting valve 138 is closed. The pistons are thereby moved rapidly towards one another due to the compressed air in the end chambers 56,58 whereby the air in the combustion chamber is compressed. When the eighth valve 145 (the fuel valve) is opened fuel is injected into the combustion chamber, thus causing the pistons to be forced away from one another under renewed compression of the air in the end chambers. The pistons are then once more brought towards one another and the free piston device continues its operation.

In a second starting procedure the fourth, the fifth, the sixth and the seventh valves 132,134,138 and 142 can be closed, while the second and the third valves 120 and 122 are opened after the pistons have first been moved away from one another, thus reducing the pressure in the combustion chamber to the pressure of the ambient air. The pistons 24,26 are thereby moved forcibly towards each other, thus compressing the air in the combustion chamber, whereupon fuel is injected into the combustion chamber and ignited. The second and the third valves 120,122 are then closed and the pressure in the end chambers is reduced to a suitable value by opening the fourth and the fifth valves 132,134, which are closed after this reduction. Compression of the air in the end chambers causes renewed movement of the pistons towards one another after the exhaust gases have been released from the combustion chamber and new air introduced thereinto, whereupon the motor's operation automatically continues.

The air bottle 112 can have been filled with air at a suitable pressure during a previous operation of the unit. Alternatively, this air bottle 112 may be filled with air from a standard starting air compressor in the known manner. This is the normal procedure for the first start-up when the unit is new or has been overhauled.

After the free piston device 10 has been started, air flows from the compressor into the first compression chambers 68,70 via the pipe 98 and is further compressed every time the pistons are moved towards one another. This air is forced on towards the intermediate cooler's air intake with each stroke, any back flow of this air being prevented by a check valve 99.

After the air has been cooled in the intermediate cooler 102, it is forced on to the second compression chambers 72,74, whereupon a portion of the air is passed to the inlet manifold 80. The remaining air is passed to the mixing container 148.

In the mixing container 148 the air from the second compression chambers 72,74 is mixed with the very hot exhaust gases from the free piston device, thus causing the temperature of the gas which is introduced into the turbine to be reduced to a temperature which the turbine can withstand. The pressure and the temperature of the air-gas mixture are raised, thus giving it a high energy content. This increase has been obtained by means of an almost direct temperature-pressure conversion in the free piston device, thus making this conversion highly efficient.

During the operation of the power unit the process computer 160 controls the valves individually. By means of the second, third, fourth and fifth valves 120,122,132,134 the pressure in the end chambers 56,58 can be adjusted. Air is preferably admitted to and discharged from the end chambers when the pressure here is at its lowest. Due to the individual control, an individual control of the pistons is achieved, e.g. in order to obtain the desired times for opening and closing of the inlet and outlet ports. Impulses from the pressure and temperature and piston position sensors are supplied together with impulses from maneuvering bodies for the gate opening or admission to the process computer 160, whose algorithms control the operation of the power unit based on these impulses.

In the power unit described above the compression ratio for the combustion chamber can be adjusted, thus continuously ensuring sufficiently high pressure in order to achieve ignition. Moreover the times for the pistons'opening and closing of the exhaust and intake ports can be adjusted, e.g. by relative variation of the pressure levels in the end chambers. This can be achieved by the electronic control of the very rapidly reacting valves which are now on the market. Since the pistons have sections which provide compression of the scavenging air, a sufficient amount thereof is ensured at all times.

One advantage of the illustrated arrangement of the rods 84,86 is that the sealing devices 88,90 are easily accessible from the outside of the cylinder 12, while those in known devices are surrounded by the cylinder 12. Furthermore the pistons can be moved mechanically by means of the rods from the outside of the cylinder, if this is required.

In the device the high pressure cylinder, i.e. the first cylinder section 14 is freely accessible from the outside of the cylinder. This provides easy access for fuel nozzles, starting valve, sensors, etc., thus facilitating the maintenance of the unit.

Figure 2:
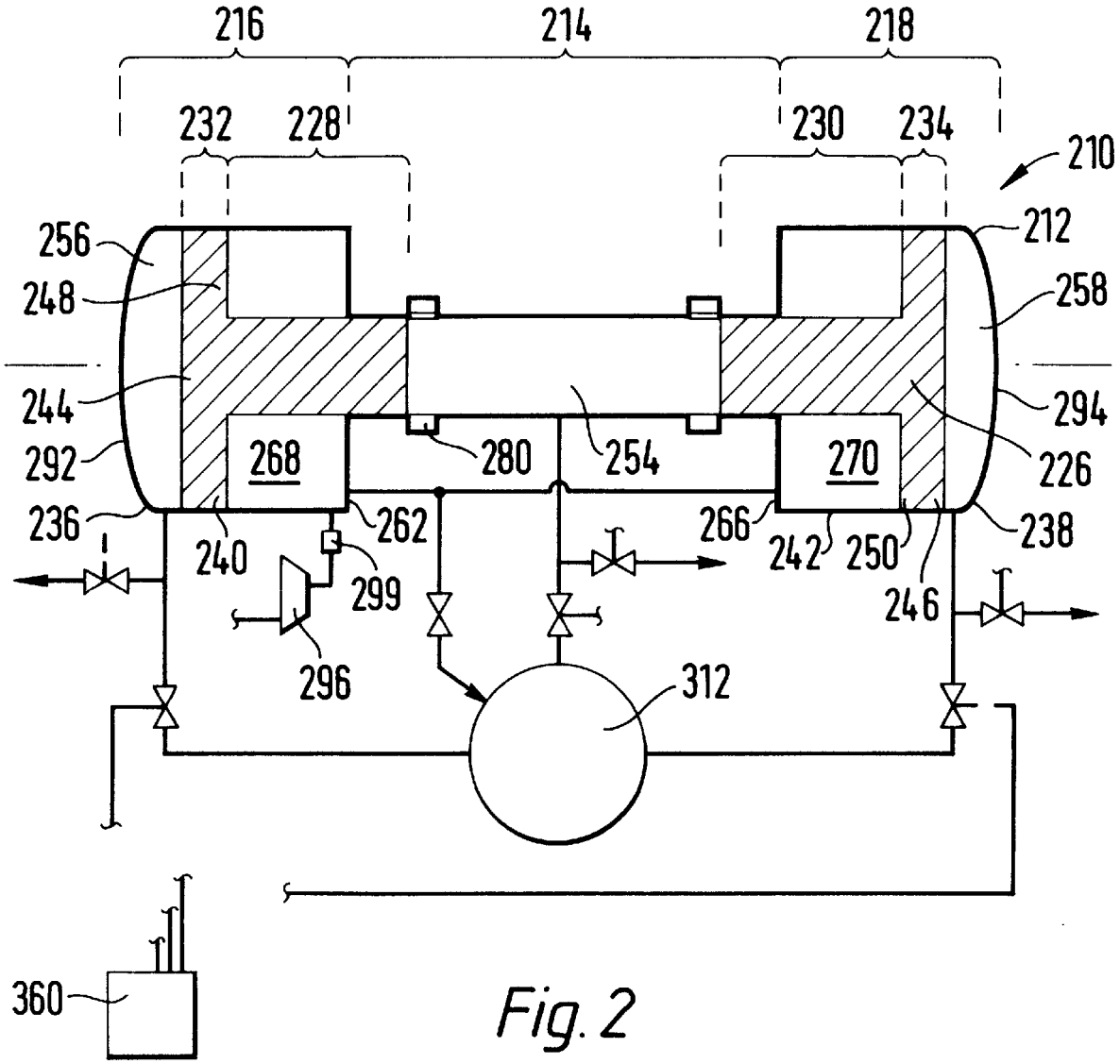
FIG. 2 is a view similar to FIG. 1, of a second, simplified embodiment of a unit according to the invention, where the components of the unit have been removed.

FIG. 2 illustrates a second, simplified embodiment of the unit shown in FIG. 1, with the second compression chamber omitted. Components of this embodiment have the same reference numeral as corresponding components of the embodiment which is illustrated in FIG. 1, but with the addition of the number 200.

FIG. 2 comprises a longitudinal section through a free piston device or gas generator 210 comprising a cylinder 212 with a first cylinder section 214 located at the cylinder's central section, and cylinder side sections 216,218, which are located at respective ends of the cylinder 212.

In the cylinder 212 there are slidably provided a left-hand and a right-hand piston 224 and 226 respectively with a first end section 228 and 230 whose diameter is adapted to the first cylinder section 214. Furthermore each piston 224,226 has a piston side section 232 and 234.

Each of the second cylinder side sections 216,218 comprises a second cylinder section 236 and 238 located at respective ends of the cylinder, and a third cylinder section 240,242 located between the first cylinder section 214 and the second cylinder sections 236 and 238 and which have a larger diameter than the first cylinder section 214. Between each of the third cylinder sections 240,242 and the first cylinder section 214 there thus extends a radial cylinder wall 262 and 266, respectively.

Similarly each of the piston side sections 232,234 comprises a second piston end section 244 and 246 respectively located at the piston ends located remotely from each other, and a third piston section 248 and 250 respectively located between the first and the second piston end section 228,244 and 230,246 respectively of the pistons 224 and 226.

Together with the first end sections 228,230 of the pistons 224,226, the first cylinder section 214 defines a combustion chamber 254.

Together with the respective second piston sections 244, 246, each of the second cylinder sections 236,238 defines an end chamber or buffer chamber 256,258.

Together with the third cylinder sections 240,242 and the third piston sections 248,250, the radial cylinder walls 262,266 define a first, left-hand and right-hand compression chamber 268 and 270 respectively.

Thus in this embodiment no second compression chamber is formed. Therefore no intermediate cooler is included. Apart from this, this unit substantially corresponds to that which is illustrated in FIG. 1 and components such as a turbine and a mixing chamber are not included in the drawing. It should be understood in this connection that the mixing chamber is supplied with exhaust gases from the free piston device and compressed air from the compression chamber.

Figure 3:
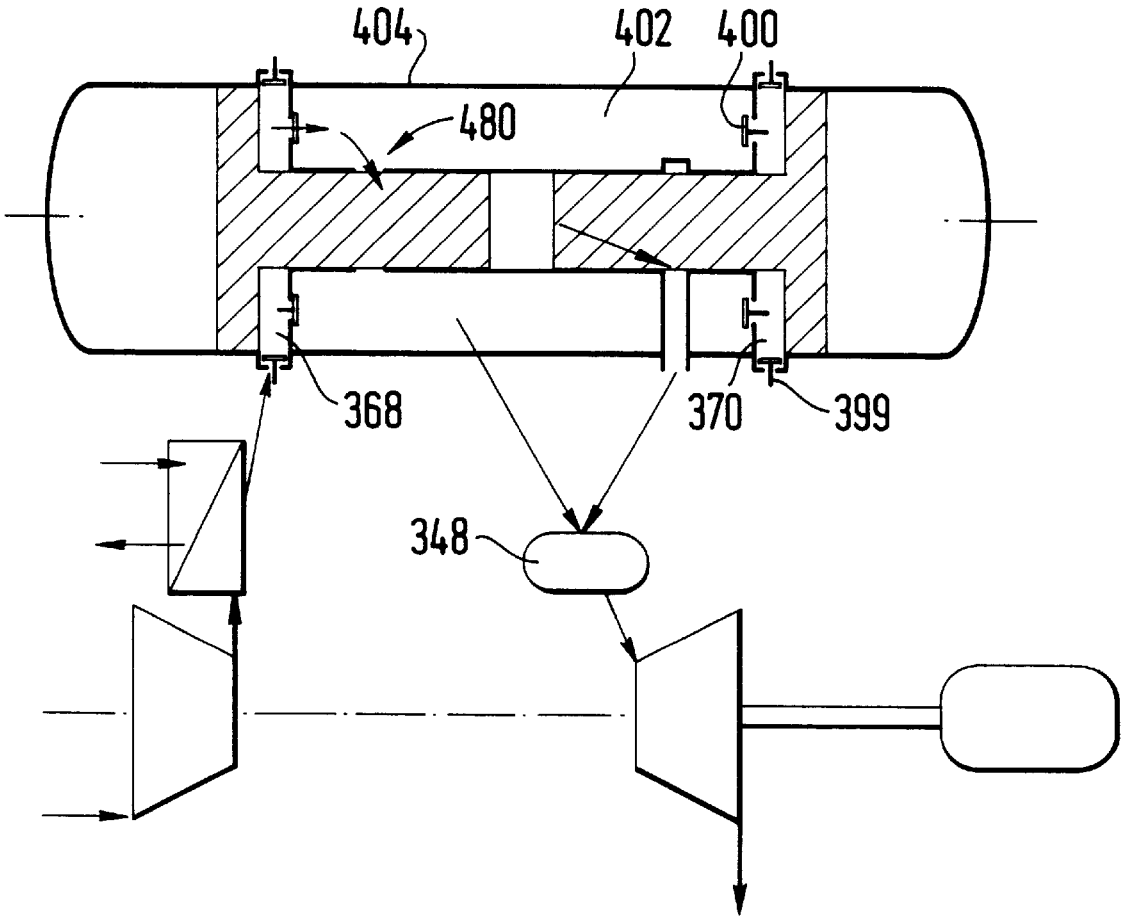
FIG. 3 shows a unit with a free piston device which is similar to the unit illustrated in FIG. 2, where the components of the unit have been removed.

FIG. 3 illustrates a third embodiment of a power unit according to the invention which is similar to that which is illustrated in FIG. 2, but where the air from the compression chambers 368,370 is supplied via check valves 399,400 to a buffer chamber or annulus 402 provided around the first cylinder section, this being surrounded by a casing or hood 404. A portion of the air in the annulus is passed into the working cylinder or the combustion chamber via inlet ports, while the rest of the air in the manifold is passed to a mixing chamber 348. This air causes a cooling of the first cylinder section together with its exhaust ports and manifold.

A cooling of the first cylinder section and associated components can also be achieved by purging the combustion chamber with compressed air from the compressor. However, it is advantageous to divide up the air, especially during running of the unit with part load, in transient phases, etc.

In this device the annulus simultaneously constitutes an inlet manifold.

It will be understood that in the pipe 98 there can be provided a cooling device for the compressed air from the compressor 96.

We claim:

1. A power unit, comprising:

a diesel free piston device having a cylinder and two pistons disposed within the cylinder and moveable in anti-phase, the pistons including first end sections located adjacent each other, and a combustion chamber defined between the first end sections and by the cylinder, and an inlet manifold in communication with the combustion chamber;

a compressor device connected to said combustion chamber via said inlet manifold for supplying air to said combustion chamber;

a mixing chamber connected to the combustion chamber for receiving exhaust gases therefrom;

a turbine connected to the mixing chamber;

pipes connecting the inlet manifold to the mixing chamber, and valves associated with the pipes for controlling air flow through the pipes; and an electronic device arranged to control said valves and thereby control the flow of air through the pipes to the mixing chamber.

2. A power unit according to claim 1, where the pistons further include second end sections which are located remotely from each other, and the diesel free piston device includes end chambers defined by the second end sections and the cylinder, and the electronic device is arranged to control air flow to and from the end chambers.

* * * * *